US006630034B1

(12) United States Patent
Schnell

(10) Patent No.: US 6,630,034 B1
(45) Date of Patent: Oct. 7, 2003

(54) FIREARM BORE CLEANER

(76) Inventor: Tim Schnell, 3708 Cobblestone Ct., Bedford, TX (US) 76021

( * ) Notice: Subject to any disclaimer, the term of this patent is extended or adjusted under 35 U.S.C. 154(b) by 105 days.

(21) Appl. No.: 09/757,723

(22) Filed: Jan. 10, 2001

(51) Int. Cl.[7] ..... B08B 9/04

(52) U.S. Cl. ..... 134/8; 134/9; 134/21.1; 134/22.11; 134/26; 134/39; 134/132; 15/104.2; 15/104.16; 15/114; 15/165

(58) Field of Search ..... 134/8, 9, 21.1, 134/22.11, 26, 39, 132, 166 R; 15/104.2, 104.16, 114, 165

(56) References Cited

U.S. PATENT DOCUMENTS

| | | | | |
|---|---|---|---|---|
| 621,857 | A | | 3/1899 | Scott |
| 821,198 | A | | 5/1906 | Stocker |
| 882,598 | A | | 3/1908 | Ward |
| 1,061,119 | A | | 5/1913 | P'Pool |
| 1,156,683 | A | | 10/1915 | Halicek et al. |
| 2,897,525 | A | | 8/1959 | Goodwin et al. ..... 15/104.165 |
| 3,205,518 | A | | 9/1965 | Romaine ..... 15/104.165 |
| 3,708,820 | A | | 1/1973 | Schultea ..... 15/104.16 |
| 4,399,627 | A | | 8/1983 | Malesky et al. ..... 42/1 BC |
| 4,716,673 | A | | 1/1988 | Williams et al. ..... 42/95 |
| 5,075,998 | A | * | 12/1991 | Selleck ..... 15/104.2 |
| 5,171,925 | A | | 12/1992 | Mekler ..... 42/95 |
| 5,588,242 | A | | 12/1996 | Hughes ..... 42/95 |
| 5,871,589 | A | | 2/1999 | Hedge ..... 134/8 |
| 5,972,125 | A | | 10/1999 | Hedge ..... 134/8 |
| 6,088,866 | A | | 7/2000 | Hedge ..... 15/140.16 |

* cited by examiner

*Primary Examiner*—Randy Gulakowski
*Assistant Examiner*—Gentle Winter
(74) *Attorney, Agent, or Firm*—Schwegman, Lundberg, Woessner & Kluth, P.A.

(57) ABSTRACT

A bore cleaner including a first flexible cord having a weighted member attached to a first end, a cleaning tool which is removably attachable to a second end of the first flexible cord in a first bore cleaner assembly, and a second, thicker flexible cord which is removably attachable to the second end of the first flexible cord in a second bore cleaner assembly and removably attachable to the cleaning tool in a third bore cleaner assembly.

6 Claims, 5 Drawing Sheets

FIREARM BORE CLEANER

FIELD OF THE INVENTION

This invention relates to the field of firearms, and more specifically to a method and apparatus for bore cleaning a firearm.

BACKGROUND

Firearms are used for target practice, hunting, law enforcement, and so on. After each shot, residue is left within the barrel from both the bullet as it leaves the gun and from the gases produced by combustion. It is important for reasons of accuracy and safety that the bore of the gun be cleaned periodically.

Typically, a gun is cleaned by attaching a brush or swab to a rod which is then pushed into the muzzle of the gun and moved up and down along the bore. One problem with this method is that the residue within the bore can be pushed up the barrel but not removed from the barrel. Moreover, it is a time-consuming process which can be unsatisfactory if a user wants to quickly clean a gun while in the field, for example.

U.S. Pat. No. 5,871,589 to Hedge shows a one-piece bore cleaner which includes a brush embedded in a cord. The cord is pulled through the gun bore and the brush cleans the bore. However, a different size bore cleaner is needed for each different size gun, and if a section of the bore cleaner gets dirty or damaged, the whole bore cleaner must be cleaned or replaced. This can result in an overall expensive bore cleaning system. Moreover, the Hedge bore cleaner does not allow the user the option of only wiping the bore without using a brush. This is a desirable option if the user wants to do a simple, quick cleaning or if the gun has delicate rifling.

SUMMARY

Accordingly, what is needed is a bore cleaning system that allows a gun to be quickly and completely cleaned while being flexible to allow for cleaning different size guns or in different situations. One aspect of the present invention provides a bore cleaner which includes a first flexible cord having a weighted member attached to one end, a cleaning tool which is removably attachable to the first flexible cord in a first bore cleaner assembly, and a second, thicker flexible cord which is removably attachable to the first flexible cord in a second bore cleaner assembly and removably attachable to the cleaning tool in a third bore cleaner assembly.

Another aspect provides a bore cleaning system which includes a single flexible cord, a plurality of different size brushes which are each removably attachable to the single flexible cord, and a plurality of different size second flexible cords which are each removably attachable to the single flexible cord and removably attachable to each of the plurality of different size brushes. Another aspect provides a two-part bore cleaning system which includes a first flexible cord having a weight member and having a brush permanently attached to an end of the first flexible cord, and a second flexible cord having a weight member and having a thicker flexible cord attached to a second end of the second flexible cord.

Among other advantages, the present modular bore cleaning system allows a user to assemble the members of the system as needed, to buy only the necessary parts for a given gun, and to choose the method of cleaning. This provides a low-cost system which is usable for a variety of guns and situations.

DETAILED DESCRIPTION

In the following detailed description, reference is made to the accompanying drawings that form a part hereof, and in which are shown by way of illustration specific embodiments in which the invention may be practiced. It is understood that other embodiments may be utilized and structural changes may be made without departing from the scope of the present invention.

Figure 1:
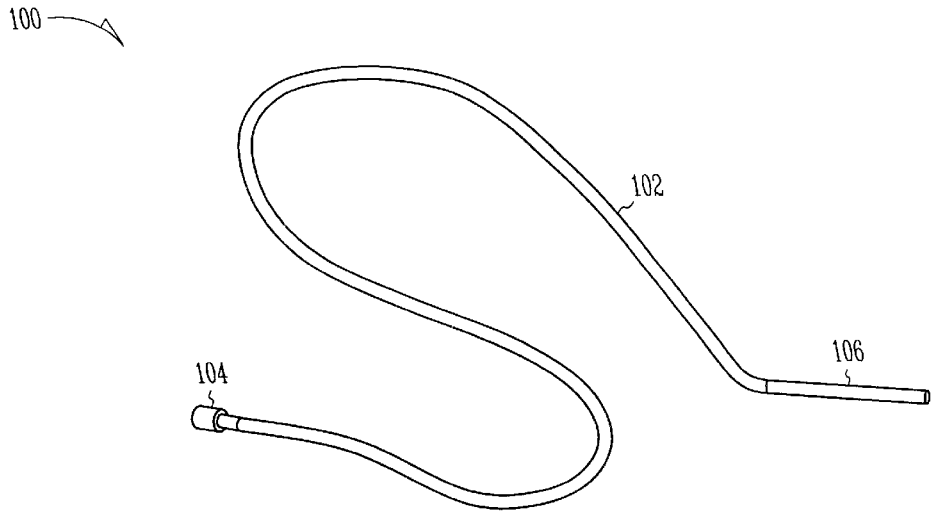
FIG. 1 shows a flexible cord for use in a bore cleaner assembly according to one embodiment of the present invention.
Figure 2:
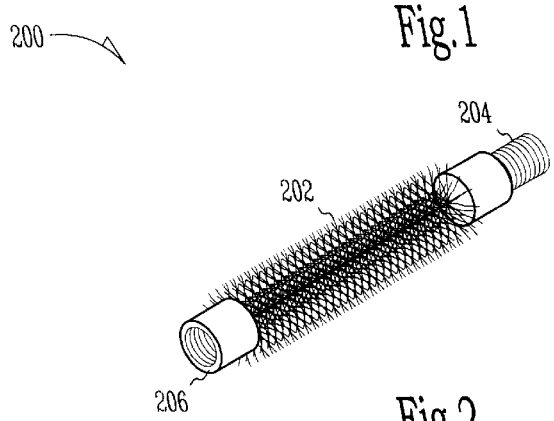
FIG. 2 shows a brush for use in a bore cleaner assembly according to one embodiment.
Figure 3:
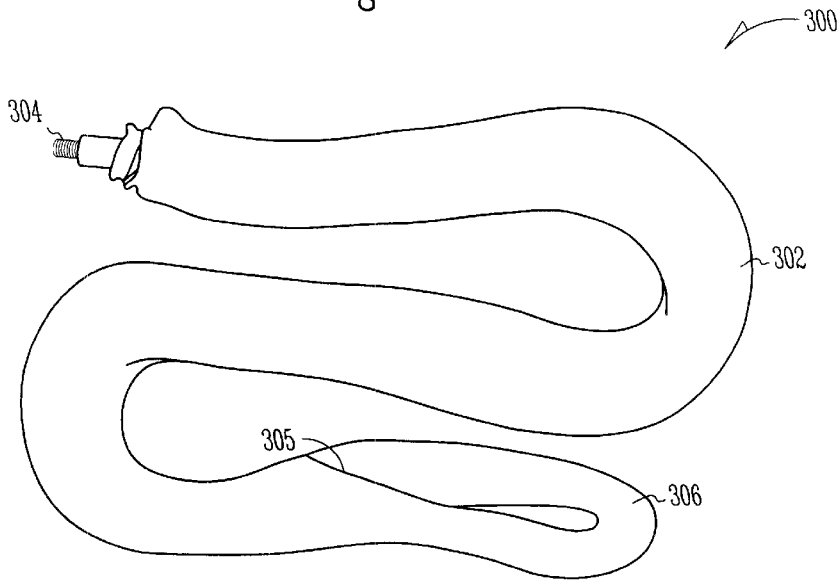
FIG. 3 shows a thick flexible cord for use in a bore cleaner assembly according to one embodiment.

FIGS. 1–3 show example members 100, 200, and 300 of a bore cleaning system according to one embodiment of the present invention. In this example, members 200 and 300 are removably attachable to member 100 and to each other to form various bore cleaning assemblies. This modularity provides a flexible system for cleaning a variety of guns each having a variety of cleaning needs.

FIG. 1 shows a flexible cord 100 according to one embodiment. Cord 100 includes a body 102, a mounting member 104 at a first end of body 102, and a weight 106 at a second end of body 102.

Body 102 is an elongated, flexible cord or rope member. Body 102 can include woven material, plastics, polymers, polyester, or other flexible or ductile material. In one embodiment, body 102 has a diameter of approximately 4 mm and an overall length of approximately 1500 mm (59"). Other dimensions are within the scope of the invention.

Mounting member 104 is for removably mounting cleaning tools, such as members 200 and 300, to flexible cord 100. In this example, mounting member 104 is a threaded female connector. As will be discussed below, members 200 and 300 include corresponding threaded male connectors for removably attaching members 200 or 300 to flexible cord 100. Alternatively, mounting member 104 can include magnet fittings, keyed attachments, or swivel attachment as will be described below.

Weight member 106 provides weight for pulling flexible cord 100 through the bore of a gun. For instance, when flexible cord 100 is put into the breech of a gun, weight member 106 falls through to the muzzle of the gun pulling the rest of cord 100 behind it. A user then pulls the cord through the rest of the bore. One or more attachments, such as member 200 or 300, or both, are attached to cord 102 to clean the inner barrel of the gun.

In one embodiment, weight 106 is a cylindrical brass member with a diameter of approximately 5 mm. In this example, weight 106 is crimped to body 102. Glue, epoxy, or other equivalents could alternatively attach the weight to the end of the flexible cord. Other materials for weight member 106 include copper or other metal, or a non-metal such as a ceramic.

FIG. 2 shows a first bore cleaning tool, a brush 200. Brush 200 includes a brush portion 202, a first mounting member 204, and a second mounting member 206. In this example, brush portion 202 includes metal bristles for scrubbing the inner surface of a gun barrel. Brush portion 202 is dimensioned to fit within a given gun barrel, and the present system provides different diameters of brushes 200 for different guns. For instance, brush 200 can have approximately a 6 mm diameter for use in a 0.22 caliber gun, approximately a 21 mm diameter for use in a 12 gauge gun, or approximately a 9 mm diameter for use in a 0.30 caliber rifle. Other diameters of brushes for different size guns are likewise used as will be apparent to one skilled in the art.

First mounting member 204 is a threaded male attachment member which is removably attachable to mounting member 104 of flexible cord 100. Thus, in one bore cleaner assembly, a user attaches brush member 200 to flexible cord 100 and pulls the assembly through the bore of the gun as described above. Second mounting member 206 is a threaded female attachment member. In one embodiment, mounting member 206 has the same dimensions as mounting member 104 of flexible cord 100. This allows cord 300 to be mounted interchangeably to either member.

The modular attachment structure of the present system thus allows a user to use different sizes of brushes 200 which each have the same size mounting member 204 and are thus interchangeably mountable to mounting member 104 of a single flexible cord 100.

FIG. 3 shows a second bore cleaning tool, a thick flexible cord 300. Cord 300 includes an elongated main body 302, a first end having a mounting member 304, and a second end having a loop 306.

In one embodiment, main body 302 includes an absorbent, woven fabric material having a filling material such as foam mounted within the body. Other embodiments can include a nylon or polyester material for main body 302. Main body 302 is dimensioned to fit compressively within the barrel of the gun to clean or wipe off the inner surface of the gun when the main body is pulled through the gun barrel.

Different sizes of flexible thick cords 300 can be used for different size guns. For instance, for a 0.22 caliber gun, cord 300 can be approximately 13 mm thick and have a length of approximately 790 mm. For a 12 gauge gun, cord 300 can be approximately 34 mm thick and have a length of approximately 620 mm. For a 0.30 caliber gun, cord 300 can be approximately 17 mm thick and have a length of approximately 790 mm. Other sizes for different guns will be apparent to those skilled in the art.

Mounting member 304 is for removably attaching cord 300 to either brush 200 or to flexible cord 100. In this embodiment, mounting member 304 is a threaded male attachment member which attaches to mounting member 202 of brush 200 and to mounting member 102 of flexible cord 100. As discussed above, other mounting methods such as magnets, keyed fittings, or the like are also possible.

Again, the present system allows a user to only purchase the sizes needed. Each different size cord 300 includes a similarly sized mounting member 304 and thus a plurality of cords are interchangeably mountable to a single flexible cord 100 and to any of a variety of brushes 200. This allows a user to use a brush and a thick cord assembly, or to use either alone, or to use first the brush and then the thick cord.

Loop 306 includes a portion of thick cord 302 folded back and connected to main body 302. In one embodiment, a slit 305 is cut into main body 302 and the end of the cord is fed into the slit. Loop 306 provides a thicker end portion for cord 300. This allows for a final cleaning or oiling of the barrel as the cord is pulled through. Alternatively, loop 306 can be omitted.

Figure 4:
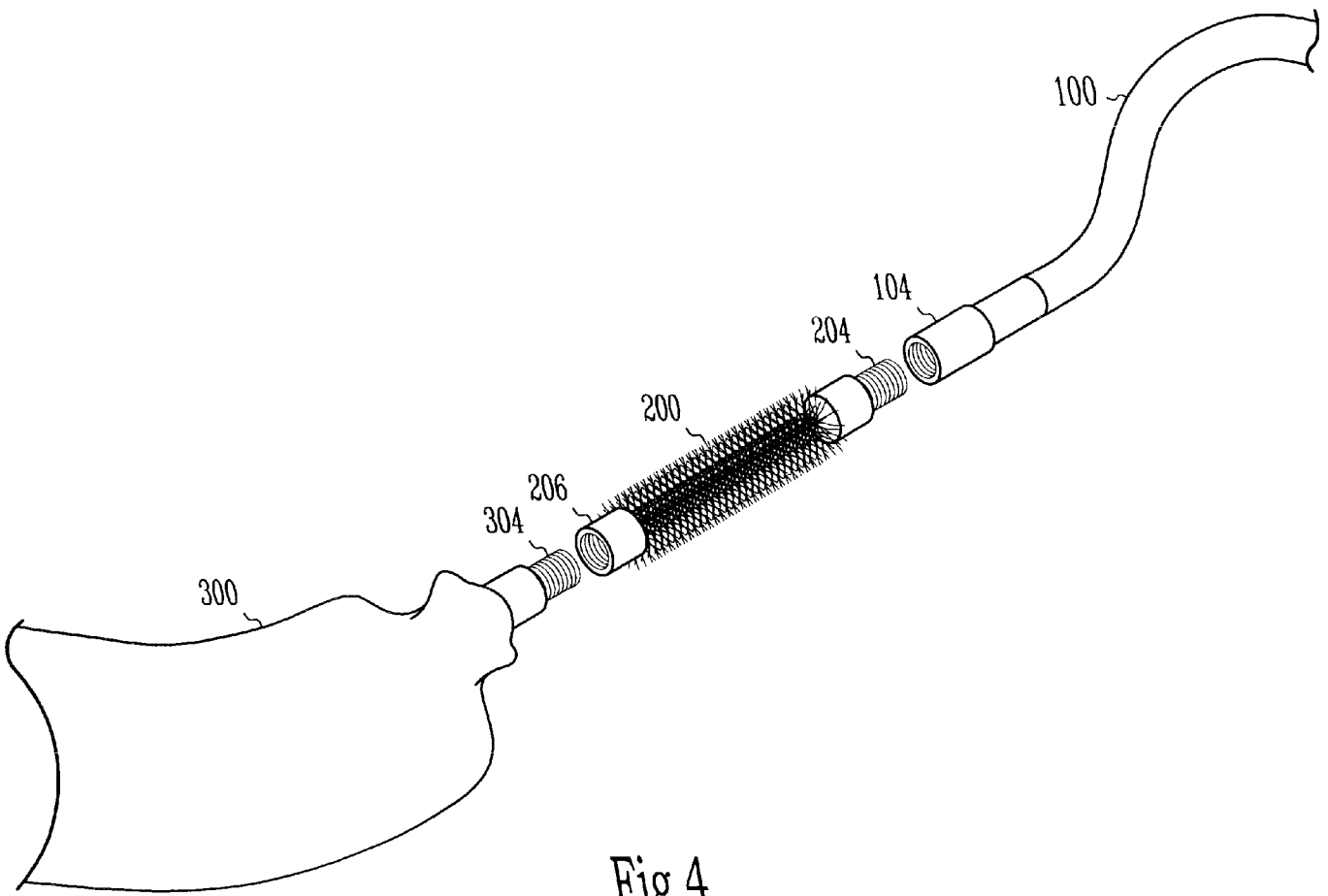
FIG. 4 shows an exploded view of the members of FIGS. 1–3.

FIG. 4 shows an exploded view of members 100–300 of the bore cleaning system. As noted above, mounting member 104 of flexible cord 100 mounts to mounting member 204 of brush 200. Mounting member 206 of the brush mounts to mounting member 304 of thick cord 300.

Figure 5:
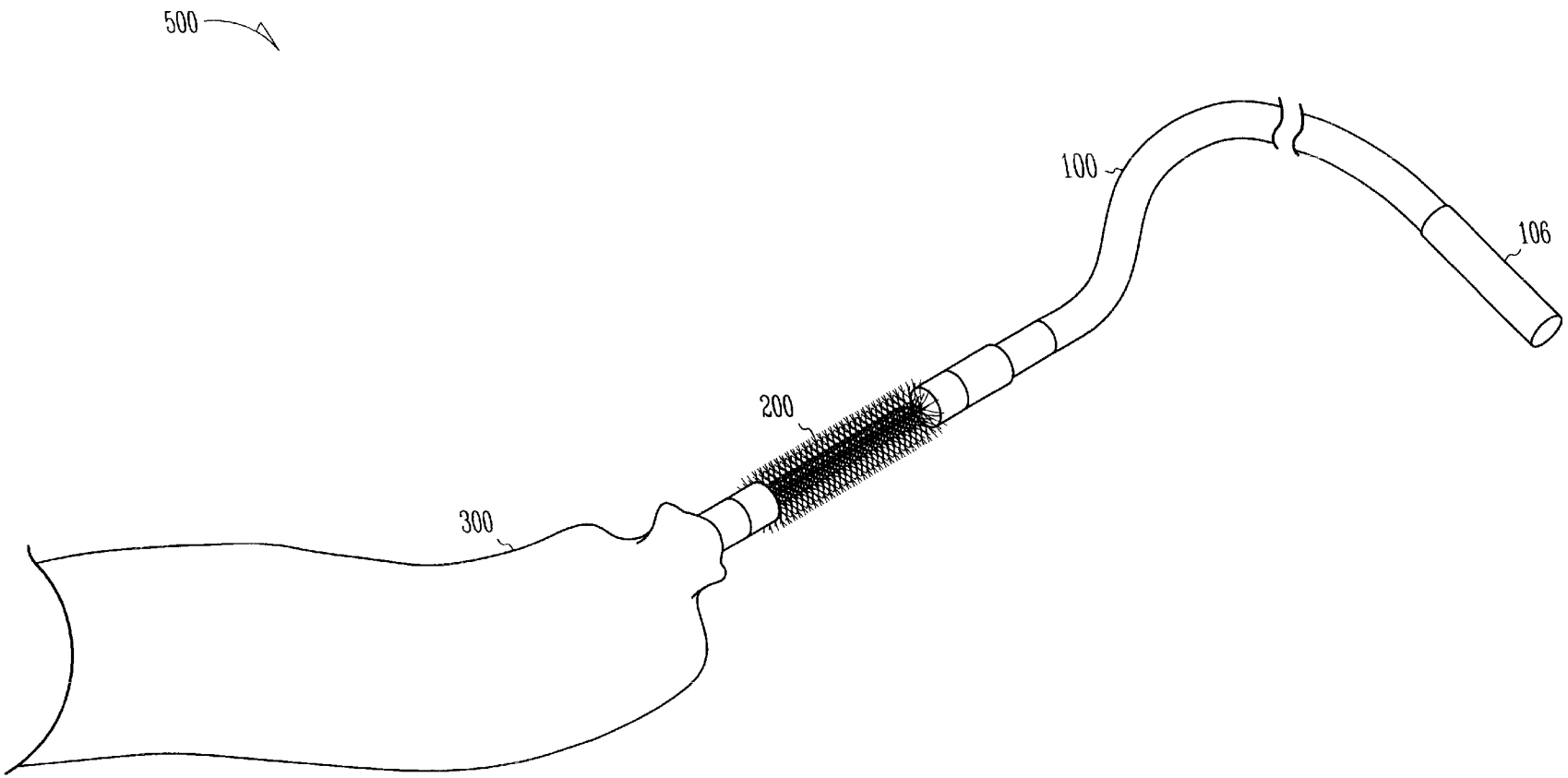
FIG. 5 shows the members of FIGS. 1–3 assembled into a first bore cleaner assembly according to one embodiment.

FIG. 5 shows an example of a first bore cleaner assembly 500 comprising the members 100–300 described above. When assembled as shown in FIG. 5, the bore cleaner can clean the barrel of a gun in a single step. For instance, a user can add some solvent, gun oil, or cleaning solution to one or more portions of brush 200 or to one or more portions of flexible cord 300. Weight member 106 is dropped into the breech of the gun, and the weight drops through the barrel and out through the muzzle. The user then pulls the rest of the assembly through the barrel. As brush 200 runs along the inner surface of the barrel it removes or loosens dirt and other built-up material located within the barrel. If a solvent is added to the brush, that further helps loosen and remove any foreign substance. After the brush has passed, thick cord 300 moves along the barrel to wipe the barrel clean. Solvent or gun oil may also be used on cord 300 to help clean and lubricate the gun. After the main body portion 302 of cord 300 has passed, loop 306 (See FIG. 3) finishes cleaning the barrel. Gun oil added to loop 306 provides a final lubricating surface for the inner surface of the barrel. Thus, a user can clean and lubricate the gun in one quick step. Moreover, since the assembly can be put into the breech and pulled toward the barrel it does not leave any residue in the bore as would happen if a brush was pushed into the muzzle of the gun and then pulled out.

The various members 100–300 can remain connected together for storage, thus not requiring a separate case. Also, one or more members of the assembly can be purchased separately as needed. For instance, a user may have a 0.22 caliber gun and thus need only first flexible cord 100, a 6 mm brush 200, and a 790 mm long, 13 mm wide thick cord 300. If the user then acquired a 0.30 caliber gun, a 9 mm thick brush 200 and a 790 mm long, 17 mm wide thick cord 300 could be purchased and used with the original flexible cord 100.

Figure 6:
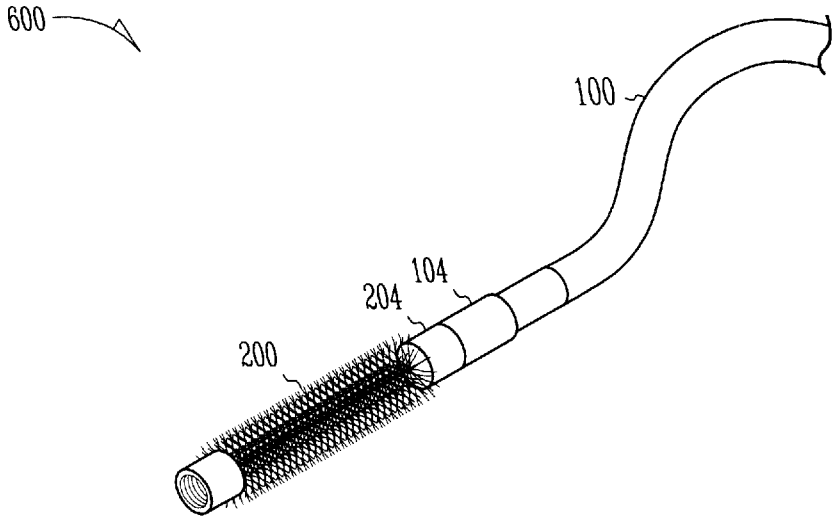
FIG. 6 shows another bore cleaner assembly according to one embodiment.

FIG. 6 shows a second bore cleaning assembly 600 assembled using flexible cord 100 and brush 200. A user may use assembly 600 if they desire using a more thorough two-step assembly or if they do not require a final wiping step. For instance, it may be desirable to pull brush 200 through a barrel a number of times before a wipe step with flexible cord 300 is needed or desired. In one option, mounting members 104 and 204 are omitted and brush 200 is permanently attached to cord 100. Such an assembly can be used by itself or in combination with one or more of the other bore cleaner assemblies described herein in either a one-step or two-step cleaning process.

Figure 7:
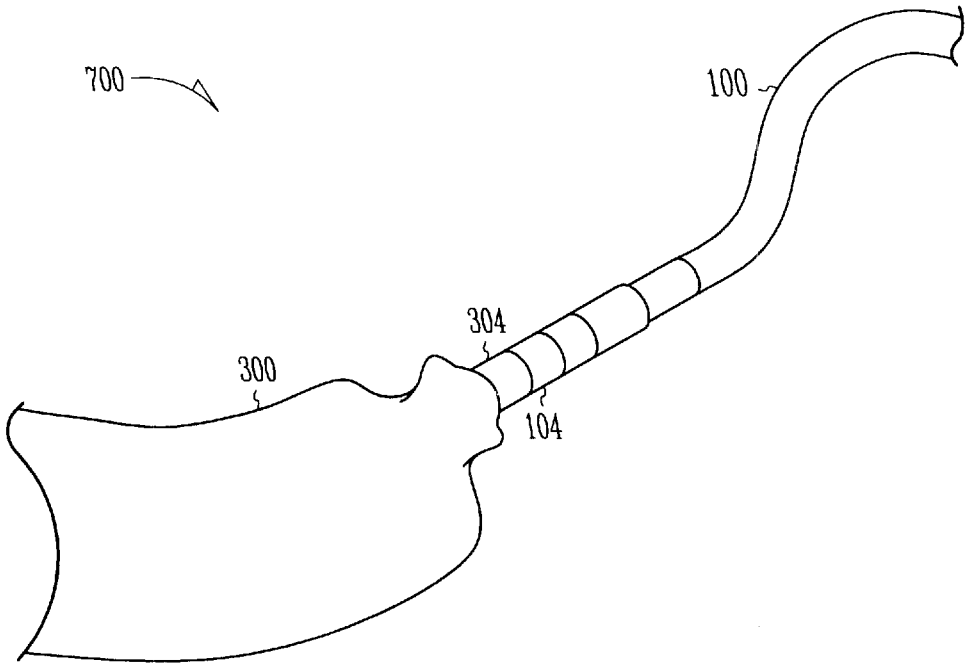
FIG. 7 shows another bore cleaner assembly according to one embodiment.

FIG. 7 shows a third bore cleaning assembly 700 assembled using flexible cord 100 and thick flexible cord 300. A user may use assembly 700 if the gun is not very dirty and they merely want to wipe it off or oil it. Additionally, a user may not want to use a brush because the gun has delicate rifling or may be damaged otherwise by the brush. Alternatively, assembly 700 is used, along with assembly 600, when a user cleans the gun using a two-step process. In this option, assembly 600 is used to do a brush cleaning of the barrel, and assembly 700 is used to wipe the barrel clean and/or add a layer of gun oil to the inner surface. Again, as a user adds more guns to their collection, they can add different sizes of either brush 200 or thick cord 300 to the system. Flexible cord 100 can hold any size a user decides to use.

In another option, mounting members 104 and 304 are omitted and the end of cord 100 is sewn into the end of cord 300 forming a permanent structure. Such an assembly can be used by itself or in combination with one or more of the other bore cleaner assemblies described herein in either a one-step or two-step cleaning process. Accordingly, a user could purchase a first cleaning assembly having a first flexible cord having a brush permanently attached to it and a second cleaning assembly having a second flexible cord having a thick flexible cord permanently attached to it. This two-part system could be used in combination or either assembly could be used by itself as needed.

Figure 8:
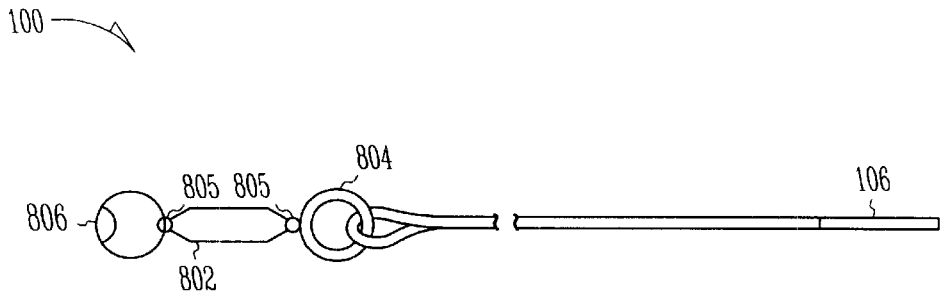
FIG. 8 shows a flexible cord for use in a bore cleaner assembly according to one embodiment.

FIG. 8 show a flexible cord 100' according to an embodiment of the invention. Cord 100' is substantially similar to cord 100 described above and includes a flexible cord body having a weight member 106 at one end. Cord 100' also includes a swivel-type attachment mounting member 802. Swivel mounting member 802 includes a first end 804 attached to a first end of cord 100', one or more swivel members 805, and a mounting portion 806. Mounting portion 806 is a threaded female mounting member dimensioned to allow brush 200 or cord 300 to be mounted to cord 100'. The swivel or rotating action provided by flexible cord 100' allows a cleaning tool such as brush 200 to turn as it is pulled through the gun. In some cases, depending on the type of gun, this provides for a better cleaning action. In other cases, it provides that the brush will turn along the rifling and not scratch it as it goes through. In one option, mounting portion 806 is omitted and a cleaning member such as brush 200, cord 300, or brush 900 (see below) is permanently attached to cord 100' using swivel mounting member 802.

Figure 9A:
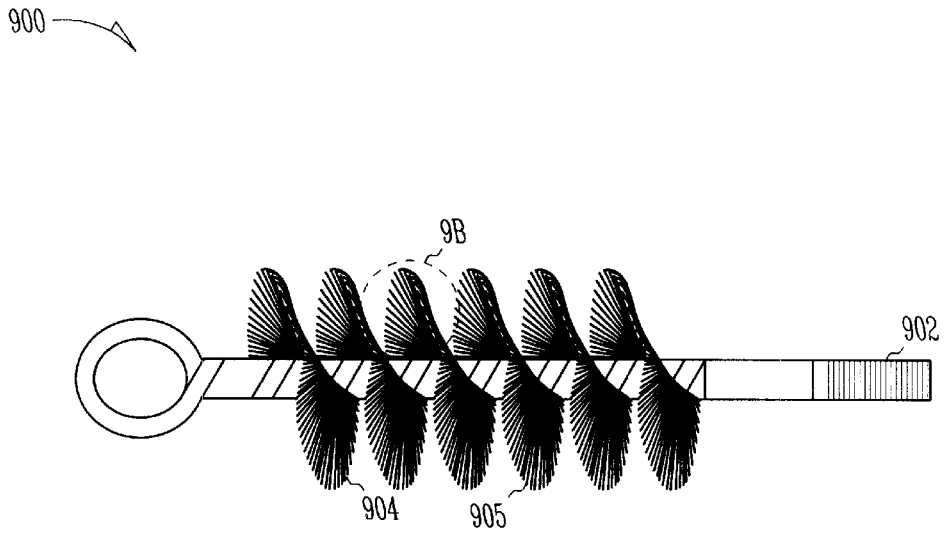
FIG. 9A shows a brush for use in a bore cleaner assembly according to one embodiment.

FIG. 9A shows a brush 900 according to an embodiment. Brush 900 is another cleaning tool which is mountable to flexible cord 100. In this embodiment, brush 900 includes a mounting member 902 which attaches to mounting member 104 of cord 100. Brush 900 includes a spiral brush structure 904 having a plurality of bristles 905.

Figure 9B:
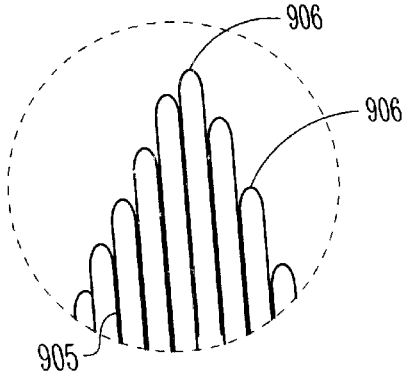
FIG. 9B shows details of the brush of FIG. 9A.

In this embodiment, bristles 905 are closed loop bristles. FIG. 9B shows a closeup of an end of a portion of bristles 905 showing the closed loop structure. The end of each bristle wire is not located at the outer tips 906 of the brush, but are circled or looped back towards the center. Thus, each outer tip 906 is a closed loop. This brush design is useful to help prevent scratches.

Other cleaning members can also be utilized within the present system. For instance, different style brushes, different size flexible cords, swabs, or other fittings and fixtures can be attached to flexible cord 100.

Conclusion

The present invention includes a bore cleaning system which provides a low-cost solution for cleaning a wide variety of guns in ways suitable to a specific user.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A bore cleaner comprising:

a first flexible cord having a weighted member attached to a first end;

a cleaning tool which is attached to a second end of the first flexible cord; and a second, thicker flexible cord which is attached by a first end to the cleaning tool, wherein a second end of the second, thicker flexible cord is formed into a loop defined by a section of the second end of the second, thicker flexible cord being folded over and inserted into a slit in an outer surface of the second, thicker flexible cord such that a tip of the second end is mounted within the thicker flexible cord.

2. The bore cleaning system of claim 1, wherein the cleaning tool comprises a brush having a first mounting member on a first end of the brush for attaching to the first flexible cord and a second mounting member on a second end of the brush for attaching to the second, thicker flexible cord.

3. The bore cleaning system of claim 1, wherein the cleaning tool comprises a brush having closed-loop bristles.

4. The bore cleaning system of claim 1, wherein the first flexible cord includes a swivel attachment member.

5. A method of bore cleaning a gun, the method comprising:

providing a first flexible cord having a weight on one end, a cleaning tool which is attached to the first flexible cord, and a second flexible cord having a thickness greater than the first flexible cord and which is attached to the cleaning tool, wherein an end of the second, thicker flexible cord is formed into a loop defined by a section of the end of the second, thicker flexible cord being folded over and inserted into a slit in an outer surface of the second, thicker flexible cord such that a tip of the second end is mounted within the second cord; and running the bore cleaning assembly through a bore of the gun.

6. A bore cleaning system comprising a flexible cord having a weighted member attached to a first end and having a swivelling attachment member located on a second end, and a brush attached to the swivelling attachment member, wherein the swivelling attachment member allows the brush to rotate as the flexible cord is pulled though a bore of a firearm.

* * * * *